US009878766B2

(12) United States Patent
Woodruff

(10) Patent No.: US 9,878,766 B2
(45) Date of Patent: Jan. 30, 2018

(54) OUTBOARD MOTOR MOUNTING APPARATUS

(71) Applicant: RAIDER OUTBOARDS, INC., Titusville, FL (US)

(72) Inventor: Christopher Woodruff, Palmetto, FL (US)

(73) Assignee: RAIDER OUTBOARDS, INC., Titusville, FL (US)

( * ) Notice: Subject to any disclaimer, the term of this patent is extended or adjusted under 35 U.S.C. 154(b) by 0 days.

(21) Appl. No.: 15/408,828

(22) Filed: Jan. 18, 2017

(65) Prior Publication Data

US 2017/0203825 A1 Jul. 20, 2017

Related U.S. Application Data

(60) Provisional application No. 62/280,604, filed on Jan. 19, 2016.

(51) Int. Cl.
*B63H 20/06* (2006.01)
*B63H 20/00* (2006.01)

(52) U.S. Cl.
CPC ..... *B63H 20/06* (2013.01); *B63H 21/26* (2013.01)

(58) Field of Classification Search
CPC ..... B63H 20/00; B63H 20/02; B63H 21/00; B63H 21/30; B63H 21/26; B63H 20/06
USPC ..... 114/61.29; 440/52; 248/640, 642, 643
See application file for complete search history.

(56) References Cited

U.S. PATENT DOCUMENTS 2,527,904 A * 10/1950 Baldwin ..... B63H 20/02 248/643
2,738,751 A * 3/1956 Hogberg ..... B63H 20/02 440/52
3,003,725 A * 10/1961 Woolbright ..... B63H 20/02 248/643
3,025,028 A * 3/1962 Corbin, Jr. ..... B63H 21/30 248/643
3,033,153 A * 5/1962 Nelson ..... B63H 20/00 248/643
3,943,877 A * 3/1976 Kemp ..... B63H 20/02 248/642
4,955,963 A * 9/1990 Snyder ..... B63H 20/02 248/640
4,966,347 A * 10/1990 Mapes ..... B63H 20/02 248/643

* cited by examiner

*Primary Examiner* — Lars A Olson
(74) *Attorney, Agent, or Firm* — Mannava & Kang, P.C.; Eliot R. Malamud

(57) ABSTRACT

Apparatus and methods for mounting an outboard motor to a transom of a boat include a transom mounting plate having a marking disposed a centerline of the transom plate and an indentation centered at the centerline for receiving clamping members of an outboard motor.

10 Claims, 6 Drawing Sheets

OUTBOARD MOTOR MOUNTING APPARATUS

CLAIM FOR PRIORITY

The present Application for Patent claims priority to U.S. Provisional Application No. 62/280,604 entitled "Outboard Motor Transom Plate" filed Jan. 19, 2016, assigned to the assignee hereof and hereby expressly incorporated by reference herein.

TECHNICAL FIELD

The disclosed embodiments relates generally to marine propulsion systems. More particularly, the invention relates to apparatus for securely mounting an outboard motor on a centerline of a transom, such that straight-line propulsion is maintained by preventing movement of the outboard motor from the centerline of the transom.

BACKGROUND

A transom is the transverse, vertical section that makes up the rear, or stern of a boat directly opposite the bow. Depending upon boat architecture, a boat propulsion system may include an outboard motor mounted on the transom. Outboard motors generally have bracket arms to embrace portions of the transom and include adjustable clamping members to secure the outboard motor to the transom.

To protect the transom, a transom plate mounts to the transom and the outboard motor is mounted to the transom plate. In order for the boat to maintain a straight line of travel the position of an outboard motor must be maintained at the center point on the transom.

In certain applications, e.g., Rubber Inflatable Boats (RIBs) running at high speed, quickly placing and securing an outboard motor, or multiple motors, exactly on the centerline of the transom is difficult. Furthermore, high speed operation through rough water may tend to shift an outboard motor from the centerline causing the boat to veer off course.

BRIEF DESCRIPTION OF THE DRAWINGS

The embodiments are described in detail in the following description with reference to the following figures. The figures illustrate examples of the embodiments.

DETAILED DESCRIPTION

Figure 1A:
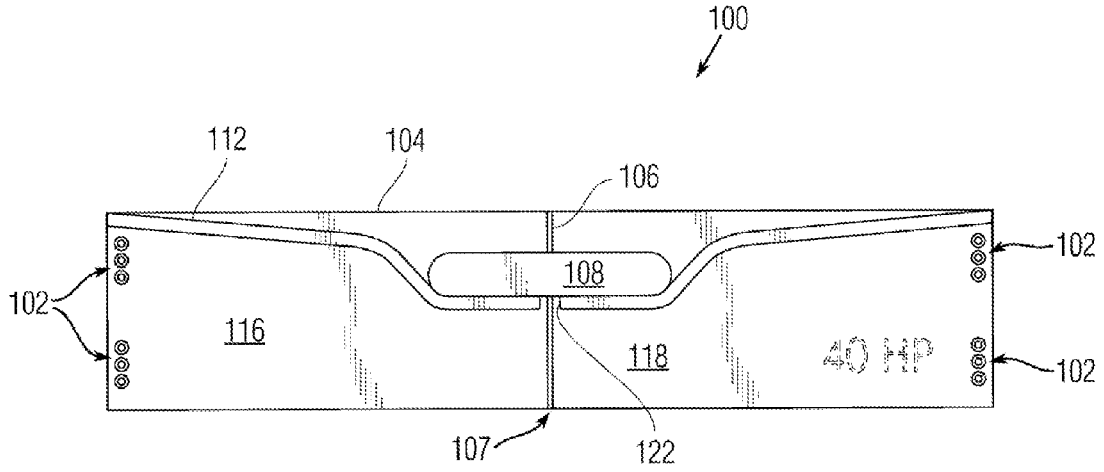
FIGS. 1A and 1B depict a plan view and a perspective view of an outboard motor transom plate according to an example of the present disclosure.
Figure 1B:
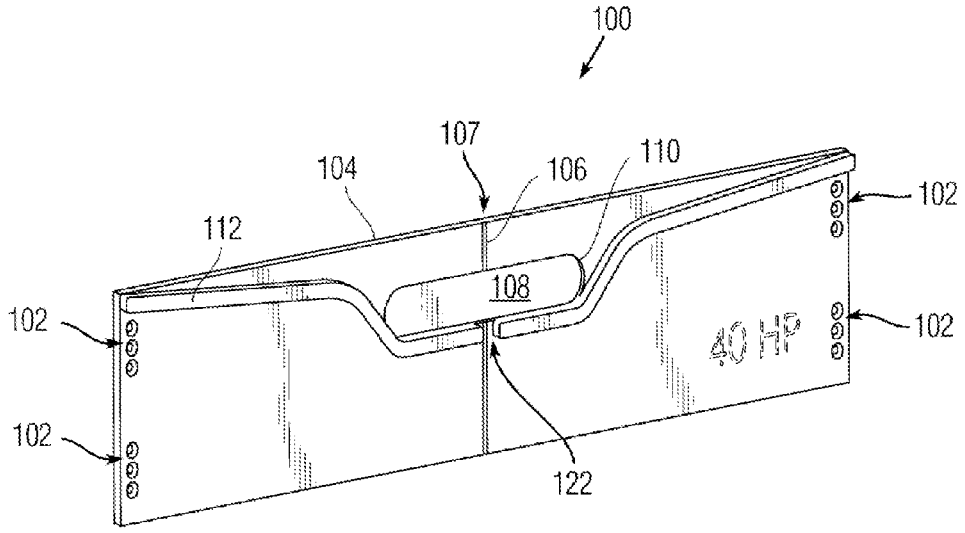

A transom plate, as described below, allows for quick and accurate mounting of an outboard motor (hereinafter "motor") to a centerline of a transom.

For simplicity and illustrative purposes, the principles of the embodiments are described by referring mainly to examples thereof. In the following description, numerous specific details are set forth in order to provide a thorough understanding of the embodiments. It is apparent that the embodiments may be practiced without limitation to all the specific details.

FIGS. 1A, 1B, 2, and 3 depict one embodiment of a transom plate 100, (hereinafter "plate 100"). Plate 100 includes mounting portions 102 to be secured, by bolts or other suitable fasteners, to a transom 202 of a boat 200.

Mounting portions 102 allow for mounting the plate 100 at different vertical location on the transom 202. The plate 100 is constructed of a material impervious to rust or corrosion, including, but not limited to aluminum, composites, and plastics.

The plate 100 includes a generally flat rectangular surface 104 having a centerline marking 106 disposed at a centerline 107 between a left side 116 and a right side 118 of the plate 100. Centerline marking 106 facilitates centering the plate 100 at a centerline of the transom 202.

An indentation 108 is formed within the surface 104 of plate 100 centered at the centerline 107 of the plate 100 and at a distance 128 below a top edge 130 of the plate 100. Indentation 108 has a length, width, and depth operable to receive motor clamping members 204 and is based upon the specific size and shape of the motor 208. Indentation 108 defines a shoulder 110. Shoulder 110 prevents a motor 208, mounted within the indentation 108, from shifting position and driving the boat off course.

Once the motor clamping members 204 are tightened, indentation 108 is operable to maintain the motor at the centerline 107 of the plate 100. Because the plate 100 is securely mounted to the centerline 210 of the transom 202, a desired course may be more easily maintained at low and high speed, and in calm and rough seas.

In an example, a mounting guide 112 extends from the upper left side 116 and upper right side 118 of surface 104 forms a surface upon which adjustable clamping members 304 of motor 208 may be rested upon when initially mounting the motor 208 to the plate 100. In other embodiments, plate 100 does not include mounting guide 112 and the motor 208 is placed directly in indentation 108.

In an example, the mounting guide 112 is formed by a flange curving downwards from the upper left and rights sides, 116, 118, of the plate 100, forming an extended bottom edge 120 of the indentation 108. The downward curving mounting guide 112 facilitates sliding the motor 208 to the indentation 108 at the centerline 107, where the clamping members 204 are securely fastened to the plate 100 within the indentation 108.

The mounting guide 112 extends laterally from the surface 104 of the plate 100 and has a width and depth sufficient to support the motor 208 while guiding the motor 208 to the indentation 108. In embodiments, mounting guide 112 has a width and a depth of approximately one-half inch to support a motor 208 of approximately 40-50 HP.

A slot 122 in the mounting guide 112 is formed at the indentation 108 to direct a flow of any water draining from the installed motor 208. In embodiments, the slot 122 is formed at the centerline 107 of the plate 100.

Figure 4A:
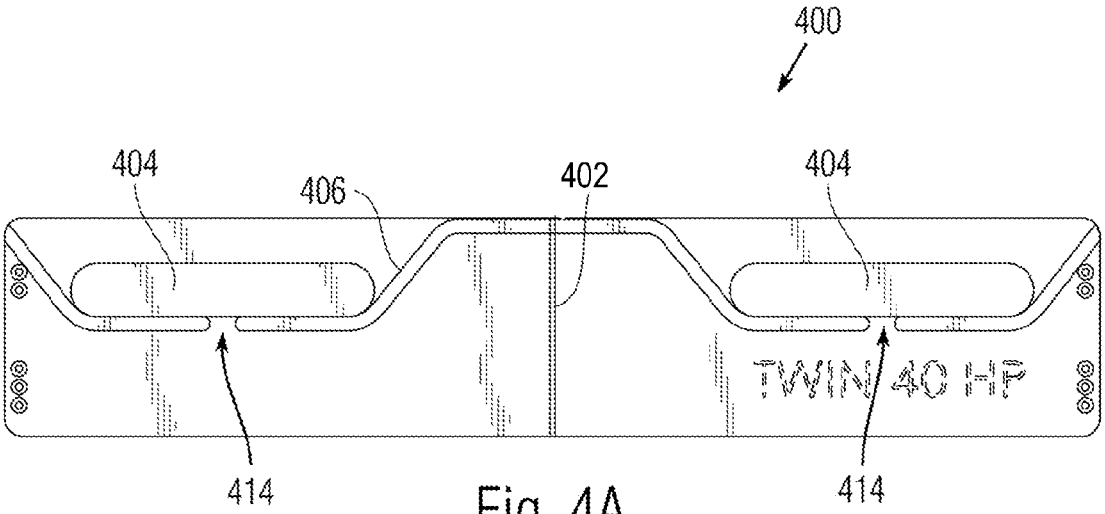
FIGS. 4A and 4B depict a plan view and a perspective view of a dual outboard motor transom plate according to examples of the present disclosure.
Figure 4B:
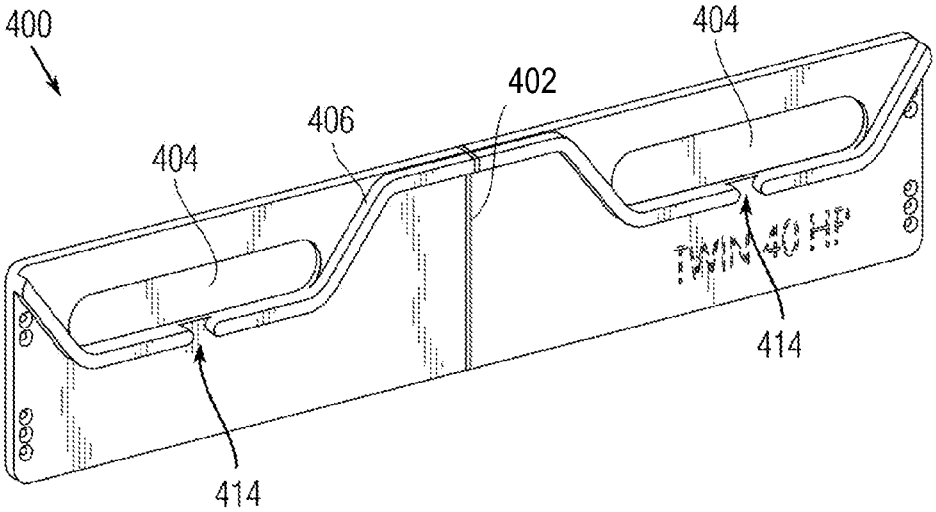

FIG. 4 depicts a dual motor transom plate 400 having two indentations 404, spaced apart to receive a pair of outboard motors. The indentations 404 are equally spaced to the left and right sides of the marked centerline 402 of the plate 400. The marked centerline 402 facilitates mounting the plate 400 at the center of a transom.

Figure 2:
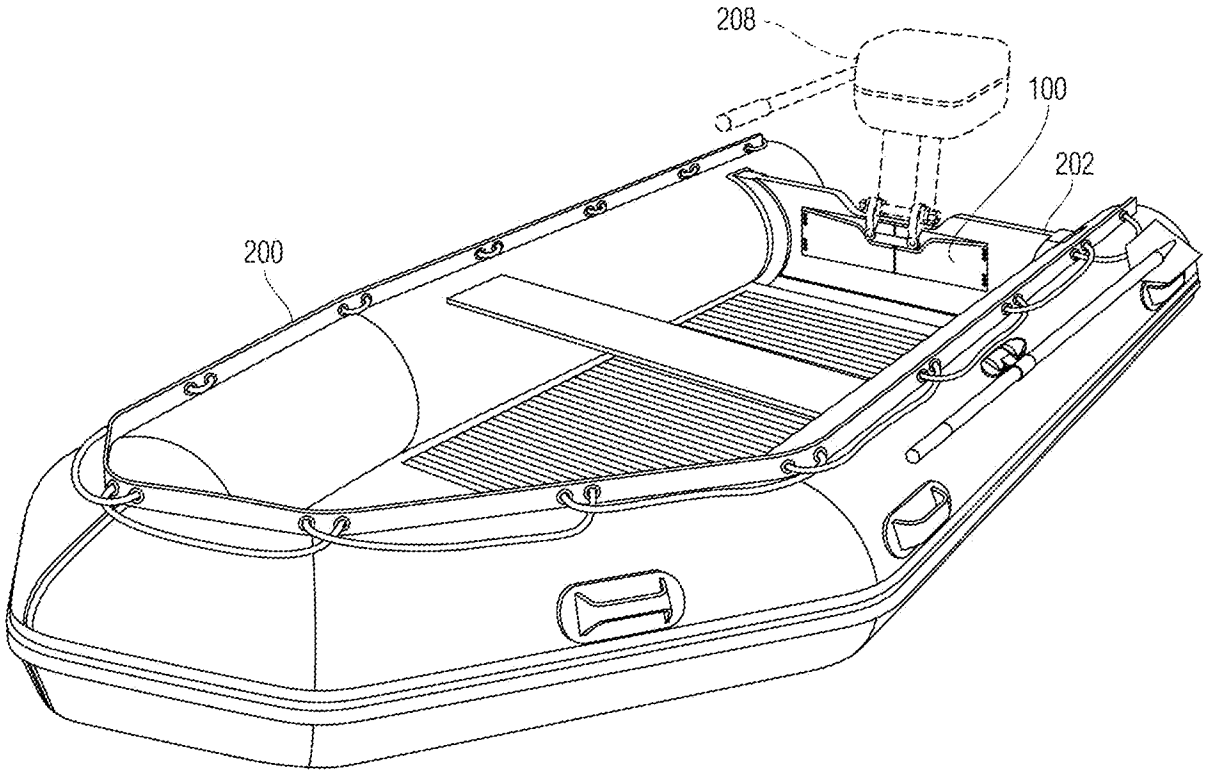
FIG. 2 is an environmental view showing the transom plate of FIG. 1 mounted to a transom of a boat, and an outboard motor mounted to the transom plate, according to examples of the present disclosure.
Figure 3:
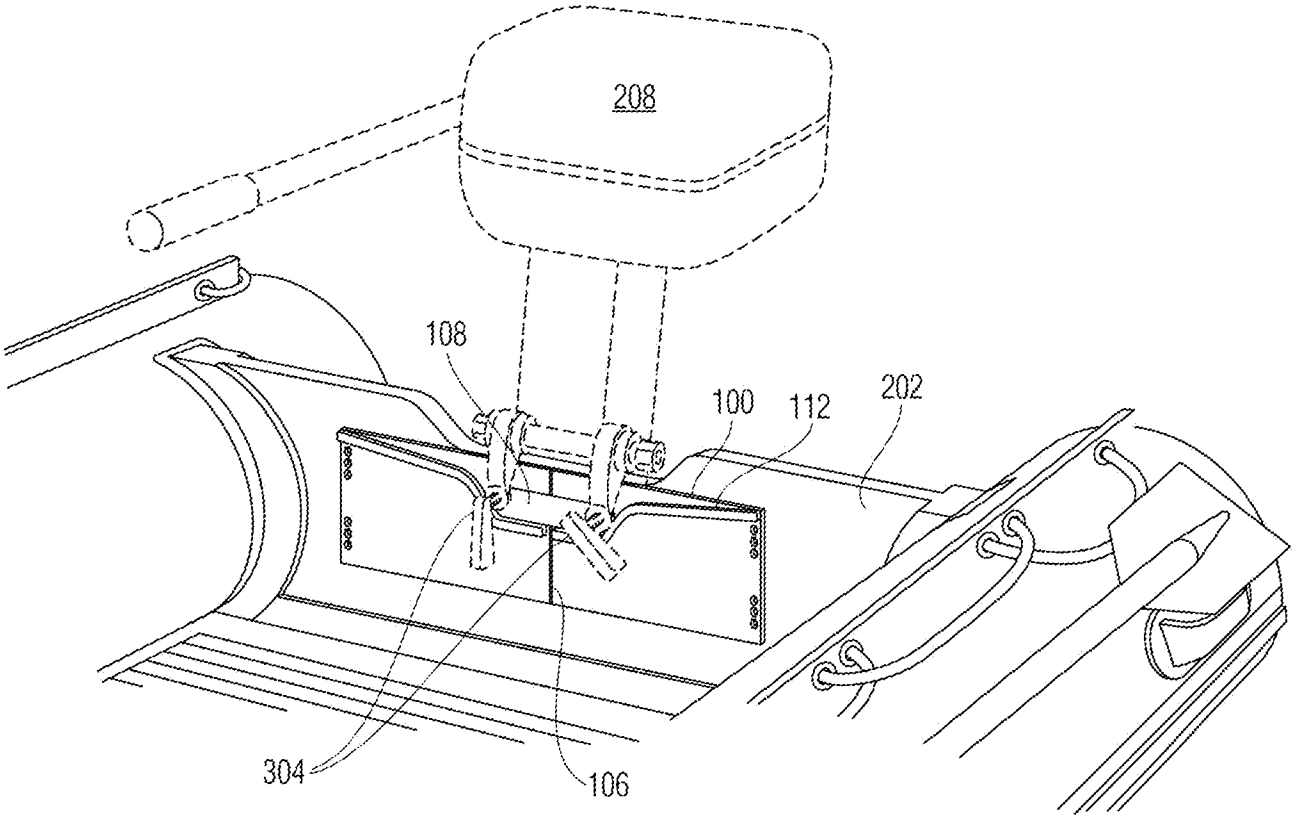
FIG. 3 is a detailed view of the transom plate depicted in FIG. 2.

Similar to the transom plate 100 depicted in FIGS. 1-3, the dual motor transom plate 400 includes a mounting guide 406 sloping downward from the left and right sides of the dual motor transom plate 400 to form bottom edges 410 and 412 of the indentations 404.

Slots 414 in the mounting guide 406 permit water to drain from the motors. In the disclosed embodiments, slots 414 are disposed in the bottom edge of the indentations 404.

Figure 5A:
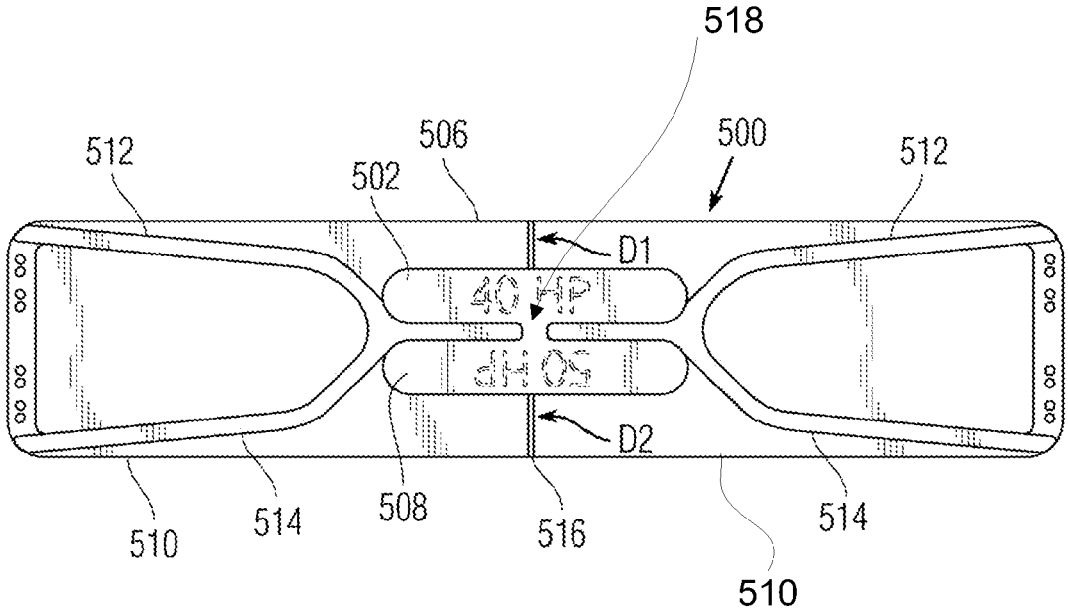
FIGS. 5A and 5B depict a plan view and a perspective view of a universal transom plate according to examples of the present disclosure.
Figure 5B:
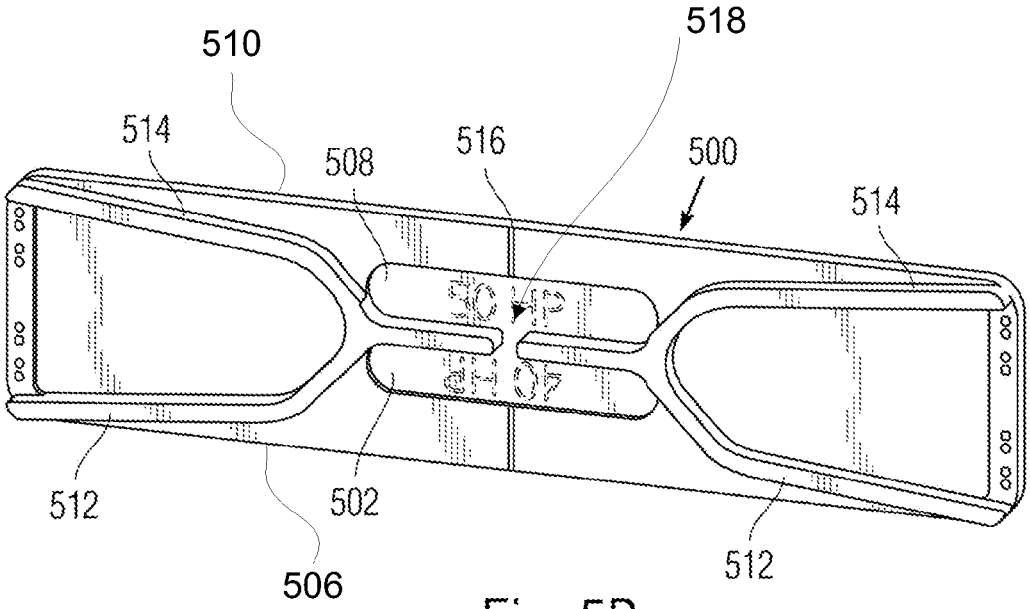

Generally, the larger horsepower of the engine, the lower the motor is positioned on the transom. FIGS. 5A and 5B depicts a transom mounting plate 500 that supports two different outboard engines size depending upon the vertical orientation of transom mounting plate 500. Centerline 516 facilitates mounting the transom mounting plate 500 to a centerline of the transom. FIG. 5B depicts the transom mounting plate 500 in FIG. 5A rotated 180 degrees.

In an example, indentation 502 is formed at a first distance D1 from an edge 506 of transom mounting plate 500 to support a outboard motor having a first horsepower rating. Indentation 508 is formed at a distance D2 from edge 510 different than the indentation 502 in order to mount an outboard motor having a horsepower rating different than the first outboard motor. Guides 512 and 514 are operable to guide the outboard motor to respective indentations 502 and 508 depending upon the orientation of the transom mounting plate 500. Guides 512 and 514 merge at indentations 502 and 508 and a slot 518 is formed in the merged guides 512 and 514 near the centerline 516 and permit water to drain from a motor mounted in either of indentations 502 and 508.

Figure 6:
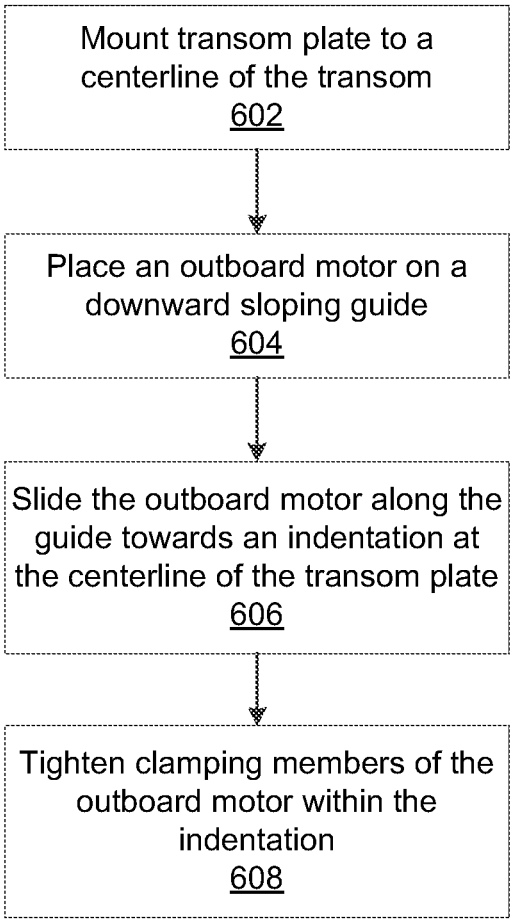
FIG. 6 is a flowchart depicting a method using the outboard motor transom plate according to examples of the present disclosure.

FIG. 6 depicts a method 600 for mounting an outboard motor to a transom according to embodiments depicted in FIGS. 1-3.

Securing mounting (step 602) transom mounting plate 100 to a centerline of the transom indicated by centerline marking 106 indicating the centerline 107 of the transom mounting plate 100.

In an example, transom mounting plate 100 includes guide 112 and motor 208 is placed on the guide 112 (step 604). At step 606, the motor 208 is urged along the guide 112 towards indentation 108. At step 608, motor clamping members 204 are tightened within the indentation 108 to secure the motor 208 to the center of the transom.

While the foregoing disclosure shows illustrative embodiments, it should be noted that various changes and modifications could be made herein without departing from the scope of the described embodiments as defined by the appended claims.

What is claimed is:

1. A transom mounting plate to be secured to a transom of a boat, the transom mounting plate comprising:

a left side, a right side, a first edge extending from the left side to the right side, and a second edge opposing the first edge, wherein the first edge is an upper edge of the transom mounting plate;

a centerline marking disposed at a centerline between the left and right sides to facilitate mounting of the transom mounting plate; and an indentation formed within a surface of the transom mounting plate at a first distance from the first edge, wherein the indentation is centered at the centerline marking, and wherein the indentation is sized to receive clamping members of an outboard motor, and a guide extending laterally outward from the surface of the transom mounting plate, the guide sloping downwards from upper portions of the left side and the right side of the transom mounting plate towards left and rights sides of the indentation, the guide forming a bottom edge of the indentation extending laterally outward from the surface, and wherein the guide facilitates sliding an outboard motor, placed on the guide, towards the indentation.

2. The transom mounting plate of claim 1, wherein the guide defines a slot beneath the indentation, the slot to allow water to drain.

3. The transom mounting plate of claim 1, wherein:

the indentation is a first indentation, the transom mounting plate includes a second indentation spaced horizontally apart from the first indentation and sized to receive clamping members of a second outboard motor, wherein the indentations are centered left and right of the centerline marking, and wherein the guide slopes downward from the left and right sides of the transom mounting plate to form bottom edges of the indentations, the guide defining edges of slots in the guide beneath the indentations.

4. The transom mounting plate of claim 3, wherein a portion of the guide between the indentations slopes upward to the first edge of the transom mounting plate, the guide defining right and left sides of the indentations.

5. The transom mounting plate of claim 1, comprising mounting portions to mount the transom mounting plate to the transom.

6. The transom mounting plate of claim 1, wherein the indentation is a first indentation, the guide is a first guide, and wherein the transom mounting plate further comprising:

a second indentation and a second guide vertically opposing the first indentation and the first guide, the second indentation disposed at a second distance from the second edge, the second distance being different from the first distance.

7. A method of propelling a boat using an outboard motor mounted to a transom of the boat, comprising:

securing, using mounting hardware, a transom mounting plate to a center of a transom of the boat using a marking disposed at a centerline of the transom mounting plate; and mounting clamping members of the outboard motor in an indentation formed at the centerline of the transom mounting plate, wherein edges defining the indentation prevents the outboard motor, mounted to the transom mounting plate, from shifting from the center of the transom, wherein mounting the clamping members in the indentation comprises:

mounting the clamping members on a downward sloping guide towards the indentation, the guide extending laterally outward from a surface of the transom mounting plate, wherein the guide forms a bottom edge of the indentation;

urging the outboard motor towards the indentation at the centerline of the transom mounting plate by sliding the clamping members along the downward sloping guide until the clamping members of the outboard motor engage the indentation; and tightening the clamping members until the clamping members are securely mounted inside the indentation.

8. An outboard motor transom mounting plate, the outboard motor transom mounting plate comprising:

a left side, a right side, an upper edge, and a lower edge;

a centerline marking disposed at a centerline between the left and right sides;

an indentation formed within a surface of the outboard motor transom mounting plate at a distance from the upper edge, the indentation centered at the centerline marking, the indentation sized to receive clamping members of an outboard motor; and a guide extending laterally from the surface of the outboard motor transom mounting plate, the guide sloping downwards from upper portions of the left and right side of the outboard motor transom mounting plate towards left and rights sides of the indentation, the guide forming an extended bottom edge of the indentation defining the right and left sides of the indentation, and wherein the guide facilitates sliding an outboard motor placed on the guide towards the indentation.

9. The outboard motor transom mounting plate of claim 8, wherein the indentation is a first indentation, the guide is a first guide, and wherein the outboard motor transom mounting plate further comprises:

a second indentation spaced horizontally apart from the first indentation and sized to receive clamping members of a second outboard motor, wherein the indentations are centered left and right of the centerline marking, and wherein the flange slopes downward from the left and right sides of the outboard motor transom mounting plate to form bottom edges of the indentations.

10. The outboard motor transom mounting plate of claim 8, wherein the indentation is a first indentation, the guide is a first guide, and wherein the outboard motor transom plate further comprises:

a second indentation and a second guide vertically opposing the first indentation and the first guide, the second indentation disposed at a distance from the lower edge, the distance from the lower edge being different from the distance of the first indentation to the upper edge.

* * * * *